US007025249B1

(12) United States Patent
Ledbetter

(10) Patent No.: US 7,025,249 B1
(45) Date of Patent: Apr. 11, 2006

(54) MAILBOX NOTIFICATION SYSTEM

(76) Inventor: Johnny R. Ledbetter, 196 Grey Stone Dr. South East, Calhoun, GA (US) 30701

( * ) Notice: Subject to any disclaimer, the term of this patent is extended or adjusted under 35 U.S.C. 154(b) by 38 days.

(21) Appl. No.: 10/822,263

(22) Filed: Apr. 12, 2004

(51) Int. Cl.
*B65D 91/00* (2006.01)

(52) U.S. Cl. ..... 232/34; 340/569

(58) Field of Classification Search ..... 232/34–37; 340/569

See application file for complete search history.

(56) References Cited

U.S. PATENT DOCUMENTS 3,611,333 A * 10/1971 Conigliaro ..... 340/539.14
4,005,816 A 2/1977 Malik
4,794,377 A * 12/1988 Benages ..... 340/569
4,868,543 A * 9/1989 Binkley ..... 340/569
4,872,210 A * 10/1989 Benages ..... 340/569
5,023,595 A * 6/1991 Bennett ..... 340/569
5,239,305 A * 8/1993 Murphy et al. ..... 340/539.1
5,255,843 A 10/1993 Deakyne
D350,298 S 9/1994 Horton
5,377,906 A 1/1995 Mason
5,449,111 A 9/1995 Sauzedde et al.
5,607,103 A * 3/1997 Boling, Jr. ..... 232/17
5,664,728 A * 9/1997 Jones ..... 232/36
5,695,113 A 12/1997 Rau et al.
5,950,919 A * 9/1999 Adams ..... 232/34
5,979,751 A * 11/1999 Maddox ..... 232/52
6,114,959 A 9/2000 Bennette
6,459,375 B1 * 10/2002 Wallace ..... 340/569
6,462,659 B1 * 10/2002 Schuette ..... 340/569
6,788,203 B1 * 9/2004 Roxbury et al. ..... 340/545.6
6,831,558 B1 * 12/2004 Andrew ..... 340/545.6
2005/0122220 A1 * 6/2005 Staples ..... 340/569

* cited by examiner

*Primary Examiner*—William L. Miller

(57) ABSTRACT

A system attachable to a mailbox for notifying a user when mail has arrived includes a housing securable to a support stand. The preferred embodiment includes opposed doors connected to each end of the housing and an identifying mechanism for determining when the mail has arrived. Such a mechanism includes a detector with a sensor and a light assembly. The detector sends a signal to the light assembly for activating a LED. The present invention further includes a remote mechanism for transmitting a signal when the identifying mechanism is activated. Such a remote mechanism includes a mobile transceiver and a stationary transceiver coupled to the detector and the light assembly. Power supply sources are coupled to the identifying and remote mechanisms. In an alternate embodiment, one of the doors can be become stationary for receiving the identifying and remote mechanisms thereat.

5 Claims, 6 Drawing Sheets

MAILBOX NOTIFICATION SYSTEM

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a mailbox and, more particularly, to a dual access mailbox that includes a wireless mechanism for alerting residents when the mail has been delivered.

2. Prior Art

In many parts of the United States, especially rural areas, mailboxes are remotely located with respect to the residence of the person to whom the mailbox belongs. Often this distance can be as much as several hundred yards or more, making it necessary to travel outside, often in inclement weather, in order to determine if mail is present.

Previous attempts to provide a device that indicates the presence of mail in the mailbox have been primarily mechanical devices, ranging from flags that pop up when the door of the mailbox is open, to springs with small ribbons on them. These previous attempts rely on the opening of the door of the mailbox as a signal that mail has been placed in the box. However, such an approach does not work if the door has been inadvertently opened and closed, if the springs or flags have not been reset or at night.

Mail is generally delivered to a box positioned adjacent the home or street of the person receiving the mail. Checking the box for the arrival of the mail can be troublesome for those individuals having a box positioned adjacent the street. This can be particularly troublesome during inclimate weather and for those suffering from various disabilities. It would be a benefit, therefore, to have a device that would provide a visual indication that is readily visible from a distance that signaled the arrival of the mail.

Furthermore, the use of mailboxes with one or more doors is known in the prior art. More specifically, mailboxes with one or more doors heretofore devised and utilized for the purpose of depositing and retrieving mail from either the front or the back of the mailbox are known to consist basically of familiar, expected, and obvious structural configurations.

Accordingly, a need remains for a mailbox that has both an alerting mechanism and allows access from the both ends of the mailbox.

BRIEF SUMMARY OF THE INVENTION

In view of the foregoing background, it is therefore an object of the present invention to provide a mailbox notification system. These and other objects, features, and advantages of the invention are provided by a system attachable to a mailbox for notifying a user when mail has arrived and includes a housing having a longitudinal axis and a substantially planar bottom surface extending parallel thereto. Such a housing is securable to a support stand and has oppositely spaced open end portions for receiving and dispensing mail therethrough. The housing further includes a plurality of latches disposed adjacent the end portions.

The preferred embodiment includes a plurality of doors connected to the housing and adjacent the end portions thereof. Such a plurality of doors have a plurality of upper lip portions extending substantially parallel to the axis that are slidably engageable between the housing and the plurality of latches respectively so that the plurality of doors can be maintained at a substantially stable closed position. One of the doors is disposed at a proximal end portion of the housing and another door is disposed at a distal end portion of the housing.

Advantageously, the present invention further includes a mechanism for identifying when mail has been placed within the housing. Such an identifying mechanism is preferably disposed partially within and partially outside select portions of the housing and adjacent one of the doors. The identifying mechanism further includes a detector having a sensor with a line of sight directed towards the distal end portion of the housing.

Of course, various sensors may be employed such as motion sensors, optical sensors and infrared sensors, for example, as well known to a person of ordinary skill in the art. The identifying mechanism further includes a light assembly including a plurality of LEDs corresponding to a plurality of different modes. The light assembly is secured to the housing substantially medially of the plurality of doors, wherein the detector generates and sends a signal to the light assembly for activating one of the LEDs.

The present invention further includes a remote mechanism for transmitting a signal to a user when the identifying mechanism is activated. Advantageously, the remote mechanism is operably connected to the identifying mechanism. Such a remote mechanism includes a mobile transceiver that is hand-operable by an operator and a stationary transceiver that is preferably disposed within the housing and operably coupled to the detector and the light assembly.

The stationary transceiver generates and sends a signal to the mobile transceiver for identifying a current mode of the system. The mobile transceiver also generates and sends a responding signal to the stationary transceiver for deactivating the current mode as desired by a user. A plurality of power supply sources are electrically coupled to the identifying and remote mechanisms respectively.

In an alternate embodiment, one of the plurality of doors can be adapted for becoming stationary and another of the plurality can be pivoted between open and closed positions. Furthermore, the identifying mechanism and the remote mechanism are secured to the stationary door. Advantageously, the alternate embodiment further includes a bracket and fastening members having hollow shaft portions provided with opposed end portions secured to the bracket and passing inwardly through one of the doors door, respectively. One of the end portions of the fastening member terminates within the housing for directing a plurality of wires therein from an exterior of the housing.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
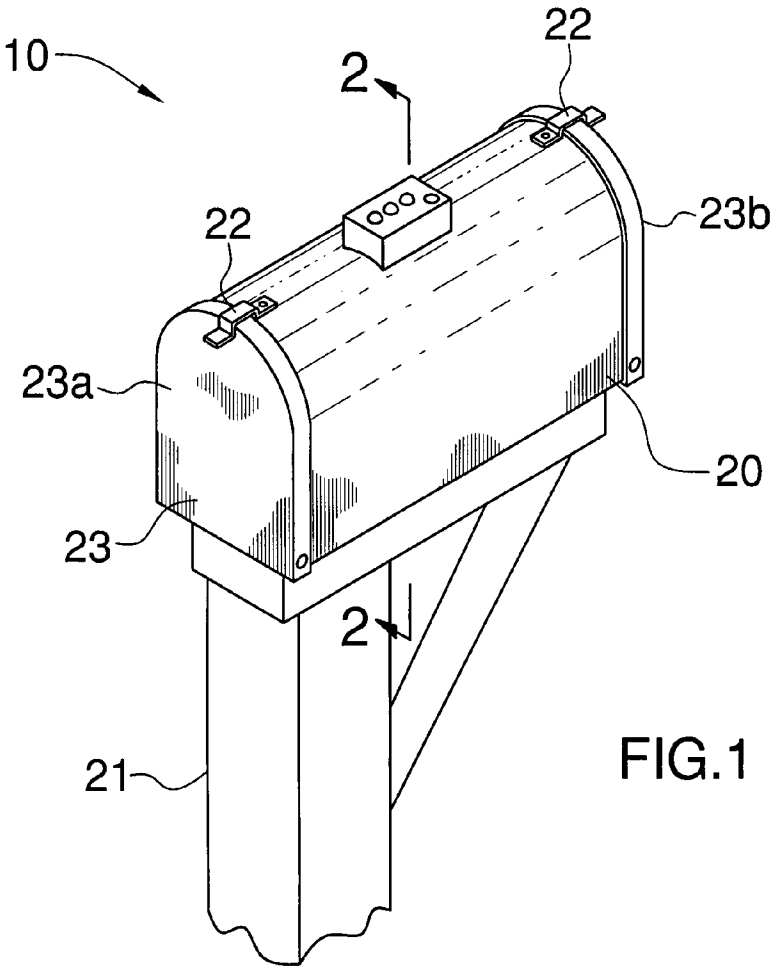
FIG. 1 is a perspective view showing a dual access mailbox including a mailbox notification system, in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout the figures. Prime and double prime notations refer to alternate embodiments of like elements.

The system of this invention is referred to generally in FIGS. 1–6 by the reference numeral 10 and is intended to provide a dual access mailbox with a wireless mechanism for alerting residence when the mail has been delivered. It should be understood that the system 10 may be employed to retrieve mail in a variety of locations including commercial business locations and a private residence.

Referring initially to FIG. 1, the system 10 includes a housing 20 having a longitudinal axis and a substantially planar bottom surface extending parallel thereto. Such a housing 20 is securable to a support stand 21 and has oppositely spaced open end portions for receiving and dispensing mail therethrough. The housing 20 further includes a plurality of latches 22 disposed adjacent the end portions.

The preferred embodiment 10 includes a plurality of doors 23 connected to the housing 20 and adjacent the end portions thereof. Such a plurality of doors 23 have a plurality of upper lip portions extending substantially parallel to the axis that are slidably engageable between the housing 20 and the plurality of latches 22 respectively so that the plurality of doors 23 can be maintained at a substantially stable closed position. One of the doors 23*a* is disposed at a proximal end portion of the housing 20 and another door 23*b* is disposed at a distal end portion of the housing 20.

Figure 2:
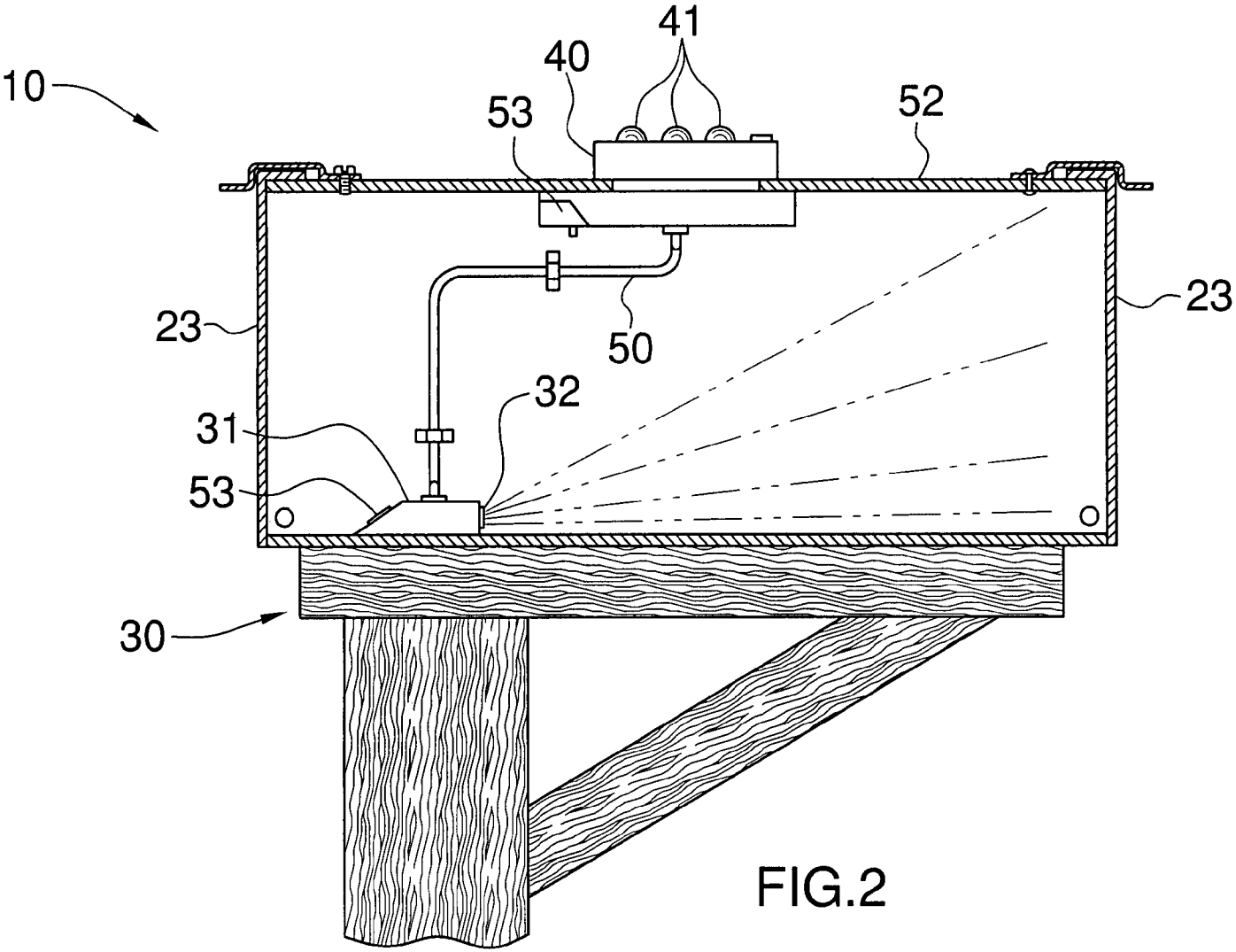
FIG. 2 is an enlarged cross-sectional view of FIG. 1 taken along line 2—2.

Referring to FIG. 2, the present invention advantageously includes a mechanism for identifying when mail has been placed within the housing 20. Such an identifying mechanism 30 is preferably disposed partially within and partially outside select portions of the housing 20 and adjacent one of the doors 23. The identifying mechanism 30 further includes a detector 31 having a sensor 32 with a line of sight directed towards the distal end portion of the housing 20. Of course, various sensors 32 may be employed such as motion sensors, optical sensors and infrared sensors, for example, as well known to a person of ordinary skill in the art.

The identifying mechanism 30 further includes a light assembly 40 including a plurality of LEDs 41 corresponding to a plurality of different modes. The light assembly 40 is secured to the housing 20 substantially medially of the plurality of doors 23, wherein the detector 31 generates and sends a signal to the light assembly 40 for activating one of the LEDs 41.

Figure 5:
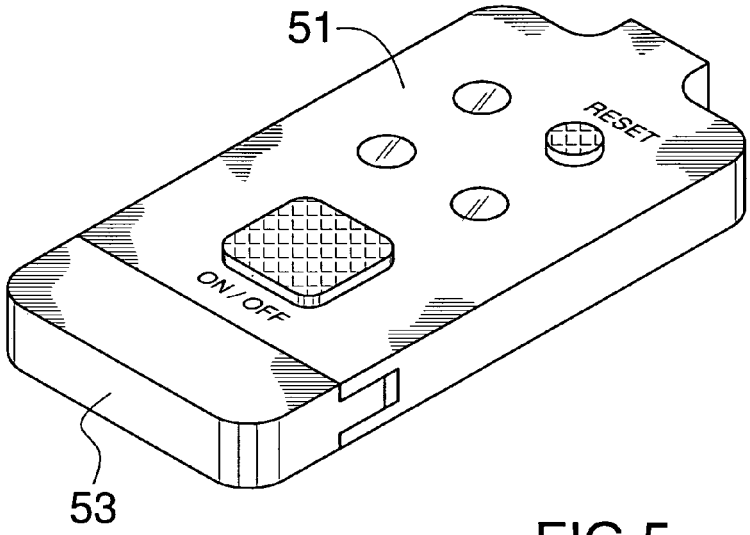
FIG. 5 is an enlarged perspective view of the remote mechanism.

Referring to FIGS. 2 and 5, the present invention further includes a remote mechanism 50 for transmitting a signal to a user when the identifying mechanism 30 is activated. Advantageously, the remote mechanism 50 is operably connected to the identifying mechanism 30 for communicating therewith. Such a remote mechanism 50 includes a mobile transceiver 51 that is hand-operable by an operator and a stationary transceiver 52 that is preferably disposed within the housing 20 and operably coupled to the detector 31 and the light assembly 40.

The stationary transceiver 52 generates and sends a signal to the mobile transceiver 51 for identifying a current mode of the system 10. The mobile transceiver 51 also generates and sends a responding signal to the stationary transceiver 52 for deactivating the current mode, as desired by a user. A plurality of power supply sources 53 are electrically coupled to the identifying 30 and remote mechanisms 50 respectively.

Figure 3:
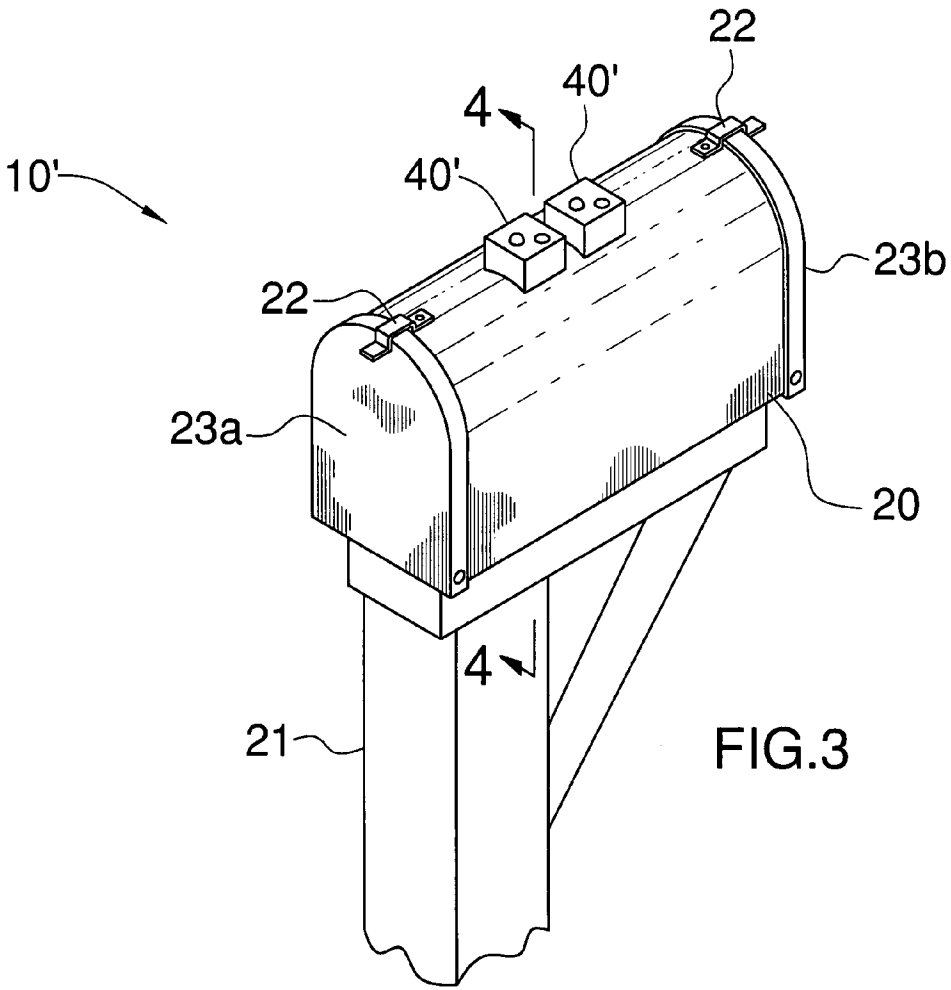
FIG. 3 is a perspective view showing an alternate embodiment of the present invention.
Figure 4:
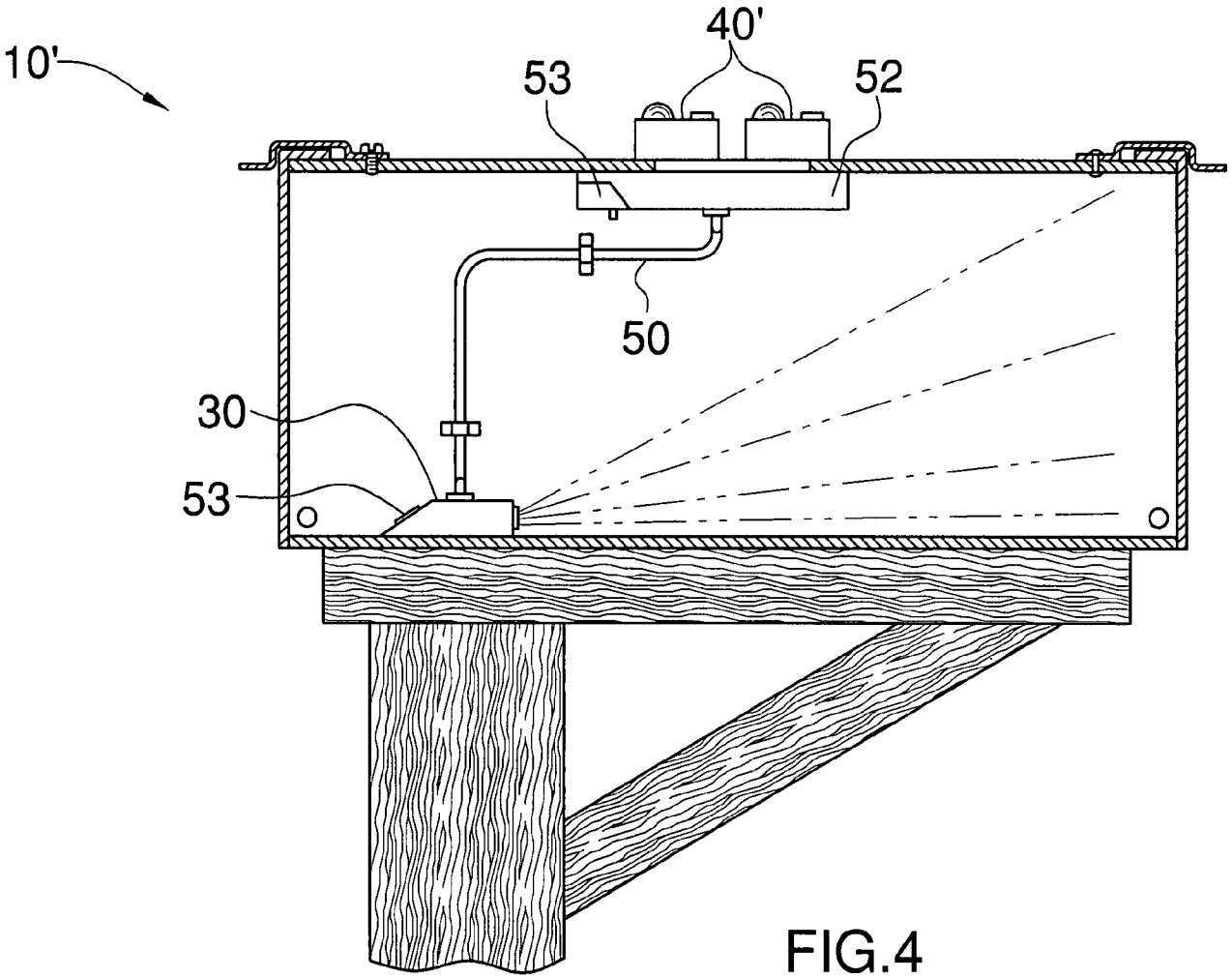
FIG. 4 is an enlarged cross-sectional view of the system shown in FIG. 3 taken along line 4—4.

Referring to FIGS. 3 and 4, an alternate embodiment 10' includes two light assemblies 40'. Each light assembly 40' notifies a different person via the remote mechanism 50 when their mail has arrived.

Figure 6:
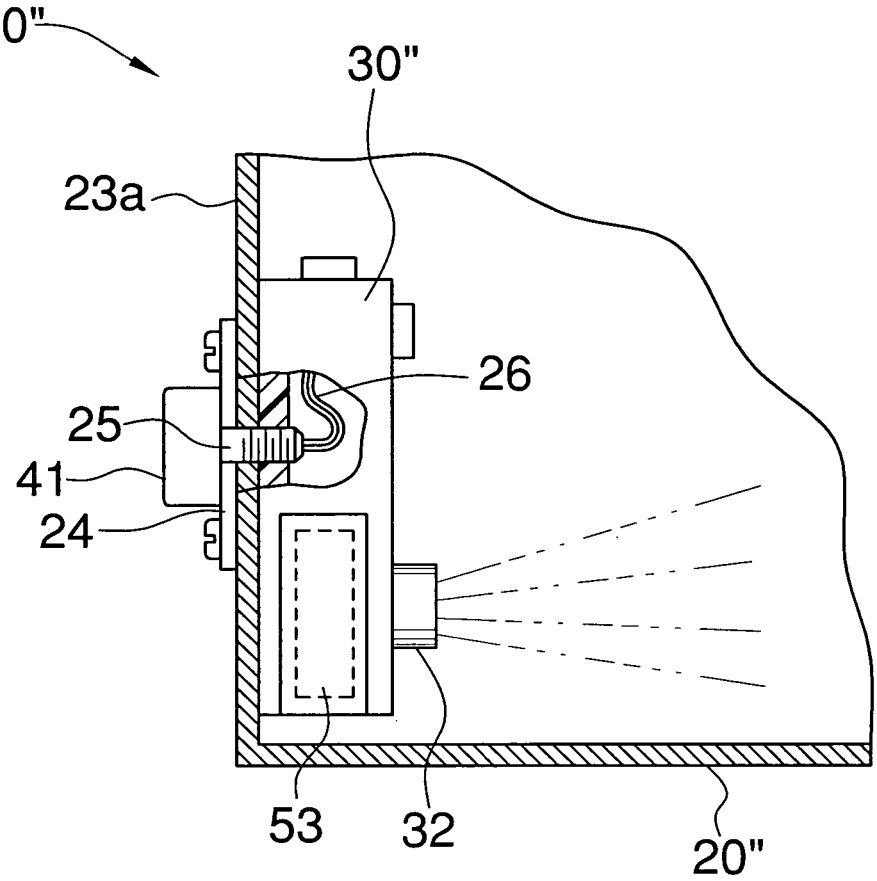
FIG. 6 is a partial cross-sectional view showing the arrangement of the identifying and remote mechanisms.

Referring to FIG. 6, in yet another alternate embodiment 100", one of the plurality of doors 23*a* can be adapted for becoming stationary and another of the plurality (not shown) can be pivoted between open and closed positions. Furthermore, the identifying mechanism 30" and the remote mechanism 50" are secured to the stationary door 23*a*.

Advantageously, embodiment 10" further includes a bracket 24 and fastening members 25 having hollow shaft portions provided with opposed end portions secured to the bracket 24 and passing inwardly through one of the doors 23*a*, respectively. One of the end portions of the fastening member 25 terminates within the housing 20" for directing a plurality of wires 26 therein from an exterior of the housing 20".

The present invention allows a user to check their mail in a variety of ways. If the mailbox is located on a busy road that makes going to get the mail risky, the present invention allows a user to retrieve the mail safely from the end opposite the road. Many houses are located some distance from the mailbox and retrieving the mail may involve a lengthy walk or even a short drive. Making several trips a day to a mailbox that far away is frustrating. The wireless alert mechanism allows residents to check for the mail without ever leaving the house. This is also helpful for those who are handicapped and/or elderly.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A mailbox system and for notifying a user when mail has arrived, said system comprising:

a housing having a longitudinal axis and a substantially planar bottom surface extending parallel thereto, said housing being securable to a support stand and having oppositely spaced open end portions for receiving and dispensing mail therethrough, said housing including a plurality of latches disposed adjacent said end portions;

a plurality of doors connected to said housing and adjacent said end portions thereof, said plurality of doors having a plurality of upper lip portions extending substantially parallel to the axis and being slidably engageable between said housing and said plurality of latches respectively so that said plurality of doors can be maintained at a substantially stable closed position;

means for identifying when mail has been placed within said housing, said identifying means being disposed partially within and partially outside of a select portion of said housing and adjacent one said plurality of doors;

remote means for transmitting a signal to a user when said identifying means is activated, said remote means being operably connected with said identifying means; and a plurality of power supply sources electrically coupled to said identifying and remote means respectively wherein said remote means comprises a mobile transceiver being hand-operable by an operator, and a stationary transceiver being disposed within said housing and operably coupled to said identifying means; wherein said stationary transceiver generates and sends a signal to said mobile transceiver for identifying a current mode of said system, said mobile transceiver for generating and sending a responding signal to said stationary transceiver and for deactivating the current mode as desired by a user.

2. The system of claim 1, wherein one said plurality of doors is disposed at a proximal end portion of said housing and another said plurality of doors is disposed at a distal end portion of said housing; and said identifying means comprises a detector comprising a sensor having a line of sight directed towards said distal end portion of said housing, and a light assembly comprising a plurality of LEDs corresponding to a plurality of different modes, said light assembly being secured to said housing and substantially medially of said plurality of doors, wherein said detector generates and sends a signal to said light assembly for activating one said plurality of LEDs.

3. The system of claim 1, wherein one said plurality of doors is stationary and another said plurality is pivotal between open and closed positions;

said identifying means and said remote means being secured to said stationary door, said system further comprising a bracket, and a fastening members having a hollow shaft portion provided with opposed end portions secured to said bracket and passing inwardly through said one door respectively, one said end portion of said fastening member terminating within said housing and for directing a plurality of wires therein from an exterior of said housing.

4. A mailbox system and for notifying a user when mail has arrived, said system comprising:

a housing having a longitudinal axis and a substantially planar bottom surface extending parallel thereto, said housing being securable to a support stand and having oppositely spaced open end portions for receiving and dispensing mail therethrough, said housing including a plurality of latches disposed adjacent said end portions;

a plurality of doors connected to said housing and adjacent said end portions thereof, said plurality of doors having a plurality of upper lip portions extending substantially parallel to the axis and being slidably engageable between said housing and said plurality of latches respectively so that said plurality of doors can be maintained at a substantially stable closed position;

means for identifying when mail has been placed within said housing, said identifying means being disposed partially within and partially outside of a select portion of said housing and adjacent one said plurality of doors;

remote means for transmitting a signal to a user when said identifying means is activated, said remote means being operably connected with said identifying means; and a plurality of power supply sources electrically coupled to said identifying and remote means respectively;

wherein one said plurality of doors is disposed at a proximal end portion of said housing and another said plurality of doors is disposed at a distal end portion of said housing;

said identifying means comprising a detector comprising a sensor having a line of sight directed towards said distal end portion of said housing, and a light assembly comprising a plurality of LEDs corresponding to a plurality of different modes, said light assembly being secured to said housing and substantially medially of said plurality of doors, wherein said detector generates and sends a signal to said light assembly for activating one said plurality of LEDs wherein said remote means comprises a mobile transceiver being hand-operable by an operator, and a stationary transceiver being disposed within said housing and operably coupled to said detector and said light assembly; wherein said stationary transceiver generates and sends a signal to said mobile transceiver for identifying a current mode of said system, said mobile transceiver for generating and sending a responding signal to said stationary transceiver and for deactivating the current mode as desired by a user.

5. The system of claim 4, wherein one said plurality of doors is stationary and another said plurality is pivotal between open and closed positions;

said identifying means and said remote means being secured to said stationary door, said system further comprising a bracket, and a fastening members having a hollow shaft portion provided with opposed end portions secured to said bracket and passing inwardly through said one door respectively, one said end portion of said fastening member terminating within said housing and for directing a plurality of wires therein from an exterior of said housing.

* * * * *